US005597204A

United States Patent [19]

Karaus, Jr.

[11] Patent Number: 5,597,204

[45] Date of Patent: Jan. 28, 1997

[54] HEIGHT ADJUSTMENT DEVICE

[75] Inventor: Donald G. Karaus, Jr., Saugatuck, Mich.

[73] Assignee: Herman Miller, Inc., Zeeland, Mich.

[21] Appl. No.: 511,702

[22] Filed: Aug. 4, 1995

[51] Int. Cl.[6] ..... B60N 2/02

[52] U.S. Cl. ..... 297/353; 297/411.36

[58] Field of Search ..... 297/353, 411.36; 248/125.3

[56] References Cited

U.S. PATENT DOCUMENTS

| | | | |
|---|---|---|---|
| 979,149 | 12/1910 | Gay . | |
| 1,210,199 | 12/1916 | Passeck . | |
| 1,400,960 | 12/1921 | Lambert . | |
| 1,569,708 | 1/1926 | Burns et al. . | |
| 2,256,856 | 9/1941 | Zwald . | |
| 2,830,653 | 4/1958 | Gaugler . | |
| 3,162,416 | 12/1964 | Amarillas . | |
| 4,043,592 | 8/1977 | Fries . | |
| 4,155,593 | 5/1979 | Swenson et al. . | |
| 4,156,544 | 5/1979 | Swenson et al. . | |
| 4,307,913 | 12/1981 | Spiegelhoff . | |
| 4,451,084 | 5/1984 | Seeley . | |
| 4,549,993 | 6/1986 | Yao | 312/333 X |
| 4,639,039 | 1/1987 | Donovan . | |
| 4,660,885 | 4/1987 | Suhr . | |
| 4,749,230 | 6/1988 | Tornero | 297/353 |
| 5,037,158 | 8/1991 | Crawford | 297/353 |
| 5,127,621 | 7/1992 | Uecker et al. . | |

*Primary Examiner*—Peter M. Cuomo
*Assistant Examiner*—David E. Allred
*Attorney, Agent, or Firm*—Brinks Hofer Gilson & Lione

[57] ABSTRACT

A device for adjusting the backrest of a chair to any of a plurality of locked positions comprising a continuous track formed in one member and a slot formed in a second member that is slidable relative to the first member. A locking pin follows along the track and traverses across the slot as the backrest is raised and lowered in the process of moving the backrest to its series of locked positions. The locking pin must circumnavigate the continuous track to complete the adjustment cycle and the person doing the adjustment has a feeling of control and confidence that the adjustment process is progressing properly throughout the adjustment cycle.

14 Claims, 5 Drawing Sheets

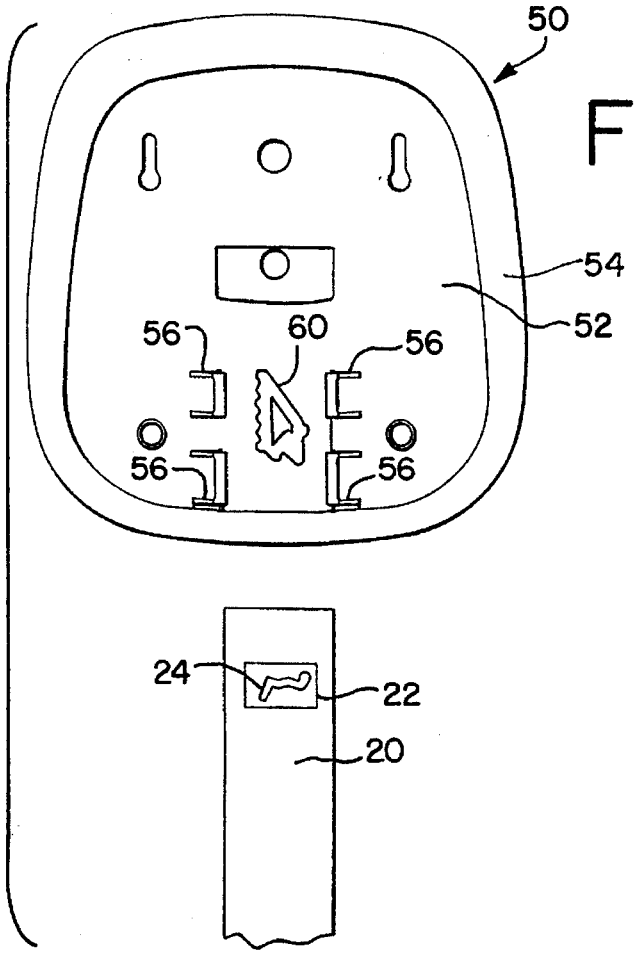
FIG. 2
FIG. 3
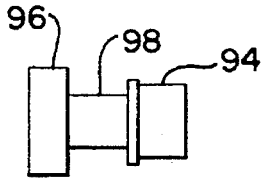
FIG. 4
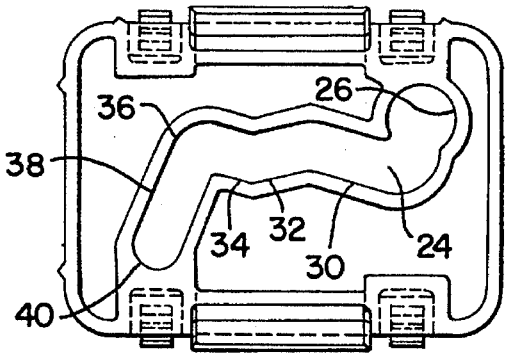
FIG. 5
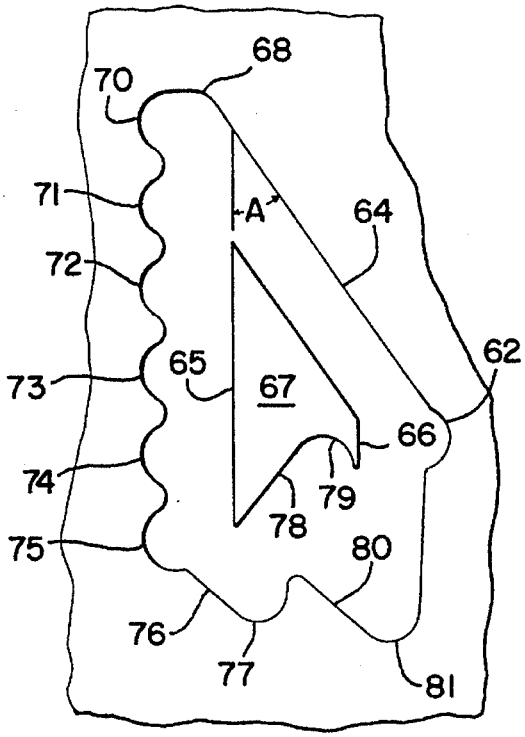

HEIGHT ADJUSTMENT DEVICE

BACKGROUND OF THE INVENTION

The present invention relates generally to a self locking adjustment mechanism and more particularly, to a mechanism that will enable the backrest of a chair to be repositioned and retained in a new position relative to the chair seat in a simple and reliable manner without the need for tools of any type.

U.S. Pat. No. 4,749,230 discloses a height adjusting device for a chair backrest that allows the backrest to be raised and locked in a selected position by merely pulling up on the backrest and releasing it at the desired height. The mechanism for accomplishing this is shown in FIG. 1A which is designated "PRIOR ART". This mechanism is very simple and includes two plates that slide relative to each other and a lock pin 3. The lock pin 3 is free to move within a slotted track 4 formed in a first stationary plate 1 that is carried by the chair support or seat. As the lock pin moves in the track 4, formed in the first plate 1, it engages cam surfaces, for example 5, formed in the second plate 2. The second plate 2 is carried by the backrest and this assembly moves vertically as the backrest is adjusted. The cam surfaces in the second plate cause the lock pin 3 to move from a first locked position 6 to a release position, as the backrest is raised, and then permits the lock pin to return to a second locked position 7. At the second locked position 7 the backrest has been elevated relative to the chair seat and its position at the first locked position 6. The adjusting process can be repeated for however many locked positions have been designed into the system. The mechanism is very easy to operate and the person doing the adjusting need only to lift the backrest and then release it for the backrest to become locked in the next elevated position. The backrest can be sequenced from its lowest location 6 to its highest location 8 and then locked in that position. When the backrest is raised from its lowest locked position 6 the lock pin encounters the cam surface 5 on the second plate 2 that guides the pin and causes it to roll up an incline 11 in the slotted track to a position where it clears the cam surface 5 and is then free to roll back down the incline 11 under the influence of gravity. When the lock pin reaches the bottom of the incline 11 the backrest is at its next adjusted position and is locked at that position. This process can be repeated to raise the backrest step by step to its highest locked position. With the backrest locked at its highest locked position 8, if the backrest is raised the lock pin 3 encounters a cam surface 9 on the second plate 2 that causes the lock pin to move further in the slotted track 4 than it moved when raised from the lower locked positions. This locates the lock pin in a depression or valley 12 in the slotted track. If the backrest is released, the lock pin will not slide down the incline 11 but will remain in the depression or valley 12. When the lock pin is so located there is nothing to prevent the backrest from free falling to its lowest locked position. The person doing the adjusting is accustomed to lifting the backrest, releasing it and having the backrest fall into its next adjusted position. When the person attempts the same procedure from the highest locked position, the backrest free falls to the lowest locked position. The person doing the adjusting feels that control of the adjusting mechanism has been lost and the mechanism is not operating properly. Thus, adjusting the backrest from its highest locked position can be annoying and causes the person doing the adjusting to question the proper operation of the mechanism.

For the foregoing reasons, there is a need for an adjustable mechanism for a backrest that can be positively and reliably moved from its highest locked position to its lowest position with the person doing the adjusting feeling in complete control of the adjusting mechanism and procedure.

SUMMARY OF THE INVENTION

According to the invention a device for adjusting and releasably locking a chair backrest in any of a plurality of vertical positions relative to the seat support is provided in which a locking devise engages a slot and a continuous track that are formed in the vertically extending strap of the seat support and the shell portion of the backrest.

According to another aspect of this invention the shell of the chair backrest and the strap portion of the seat support include engaging slide slots and slide edges formed therein such that the backrest slides vertically on the vertically extending strap portion of said seat support and can be locked in any of a plurality of locations.

According to another aspect of this invention a continuous track is formed in hard material carried by the shell portion of the backrest and said continuous track is in overlapping relationship to a slot formed in the strap.

According to still another aspect of this invention a locking device for releasably locking the backrest to the vertically extending strap portion of the seat support comprises a lock pin that includes a track follower portion that is slidable in the track, a head portion that is adapted to engage the vertical strap portion along the periphery of the slot and a slot follower portion that connects the track follower portion to the head portion and is slidable in said slot.

According to another aspect of this invention the locking pin must circumnavigate the continuous track to cycle from a vertical locked position, through all other vertical locked positions and return to its starting vertical locked position.

According to still another aspect of this invention the backrest must be raised and released multiple times to progress from the highest locked position to the lowest locked position.

The present invention is directed to a mechanism that satisfies this need. The mechanism of this invention comprises a track formed by a continuous groove that is slidable relatively to a plate having a slot formed therein and a locking pin. The locking pin includes portions that follow both the continuous track and the slot. The locking pin will progress in only one direction around the continuous track. An operator can grasp the backrest, that is at any of its adjusted positions, raise it then release it and the backrest will have advanced to its next highest locked position. When the backrest has reached its highest locked position, if the backrest is raised and then released it will not free fall to its lowest locked position. Rather when the backrest is raised from its highest locked position the lock pin will move to a first rest position with the backrest at a position slightly elevated from its highest locked position. When the backrest is released, after being raised from its highest locked position, it will fall to a stopped position that is at an elevation approximately equal to the second highest locked position. This lowering of the backrest will clearly communicate to the person doing the adjusting that the backrest was at its highest locked position and has now started its descent. From the stopped position the backrest is again raised and released. From the stopped position the backrest can be moved to an elevation that is its highest possible position.

This new position is higher than the position that it attained when raised from its highest locked position. When released from this highest possible position the backrest will move to its lowest locked position. However, it will not be a free fall trip since the lock pin encounters a second upwardly inclined cam surface in the continuous track that it must climb and two inclines and a decline in the slot that it must negotiate before reaching the lowest locked position. Thus an attempt to raise the backrest higher than its highest locked position results in the backrest stopping at two rest positions and a stop position, before it starts its decent to its lowest locked position. When released from the second rest position the backrest will move to its lowest locked position, however it will fall in a controlled fashion and will not free fall. Throughout this process of raising the backrest from its highest locked position, the operator is in complete control of the backrest and is required to lift and release twice to permit the backrest to move to its lowest locked position. Throughout this adjustment procedure from the highest locked position to the lowest locked position the person doing the adjusting always feels that the process is in control and the mechanism is operating properly.

BRIEF DESCRIPTION OF THE DRAWINGS

An embodiment of the invention is shown in which:

FIG. 2 is a rear exploded view of the chair back and back strap of this invention.

FIG. 3 is a side view of the locking pin of this invention.

FIG. 4 is a plan view of a plate that can be mounted in the back strap having a slot formed therein.

FIG. 5 is a portion of the chair back shell having the continuous track formed therein.

DETAILED DESCRIPTION OF THE PREFERRED EMBODIMENT

Figure 1A:
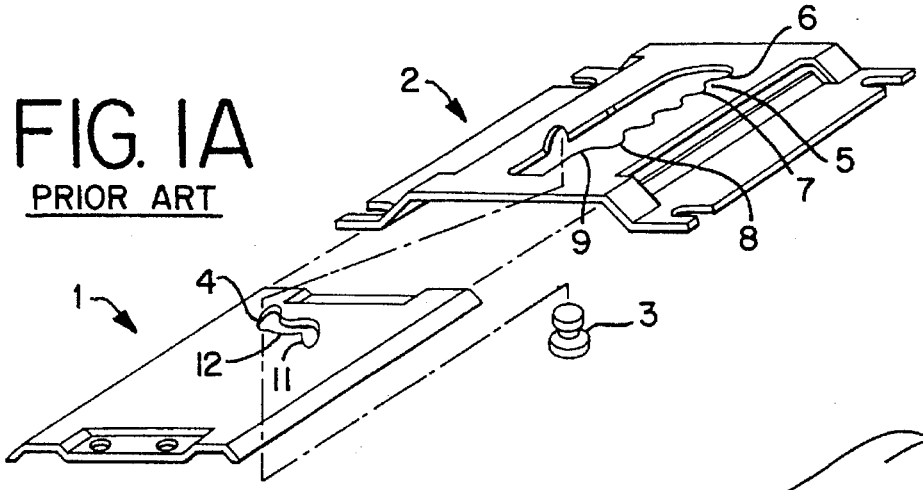
FIG. 1A PRIOR ART
FIG. 1A is a perspective view of a prior art mechanism. This view has been labeled PRIOR ART.
Figure 1:
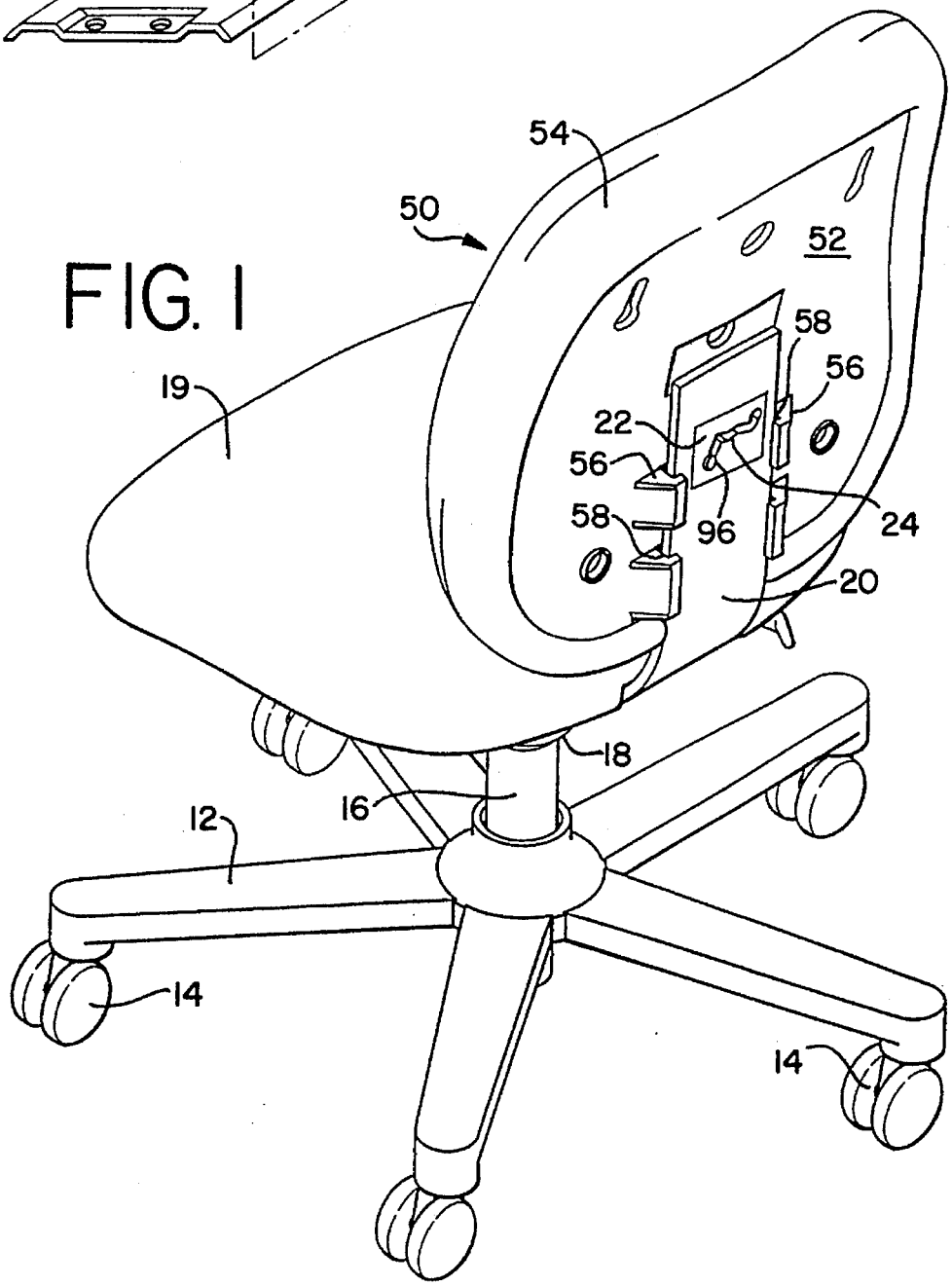
FIG. 1 is a perspective view of a chair including the chair back adjustment of this invention.
Figures 6, 7, 8:
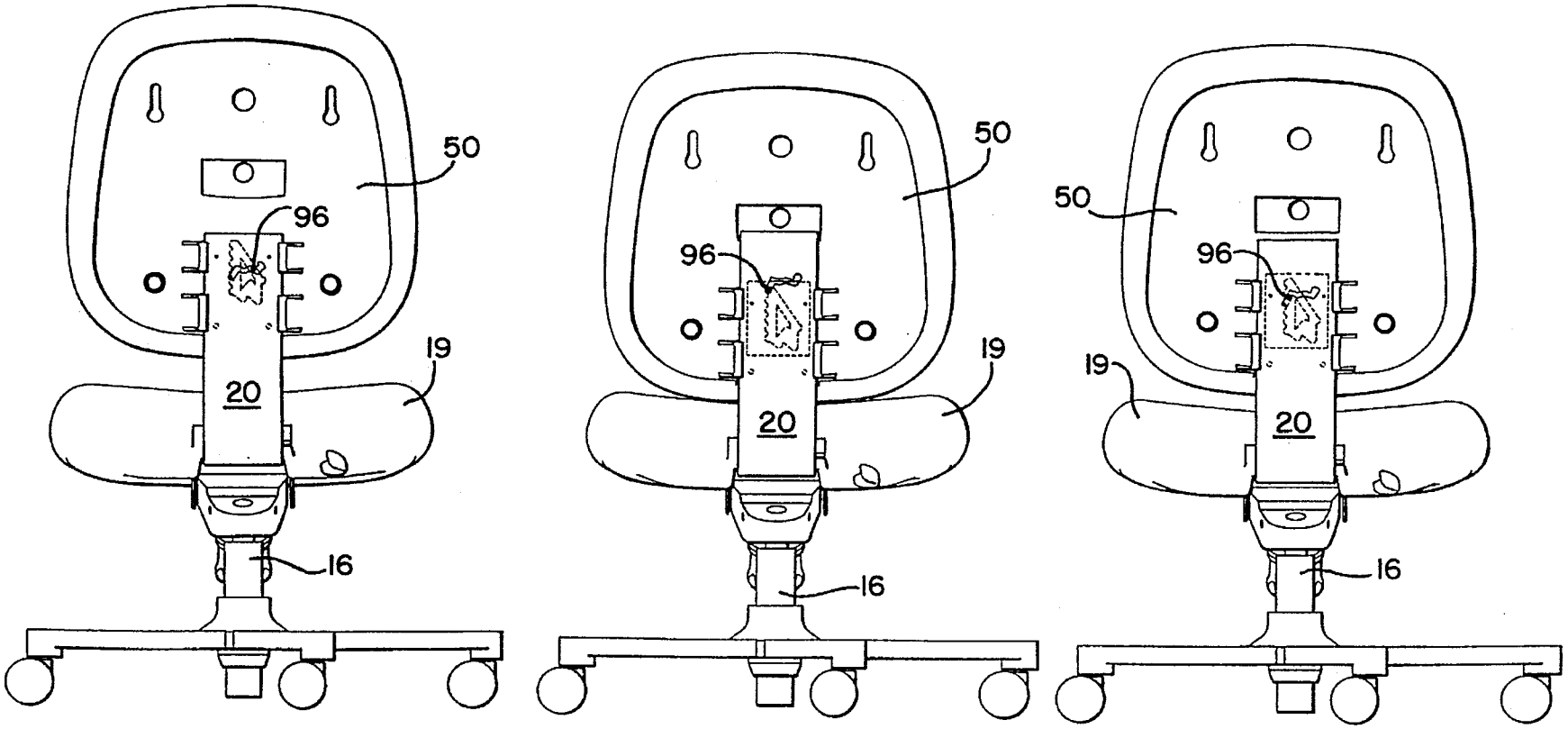
FIG. 6 is a back view of a chair with the backrest midway between the second rest position and its lowest locked position.
FIG. 7 is a back view of a chair with the backrest at the lowest locked position.
FIG. 8 is a back view of a chair with the backrest between the second and third locked position.
Figure 11:
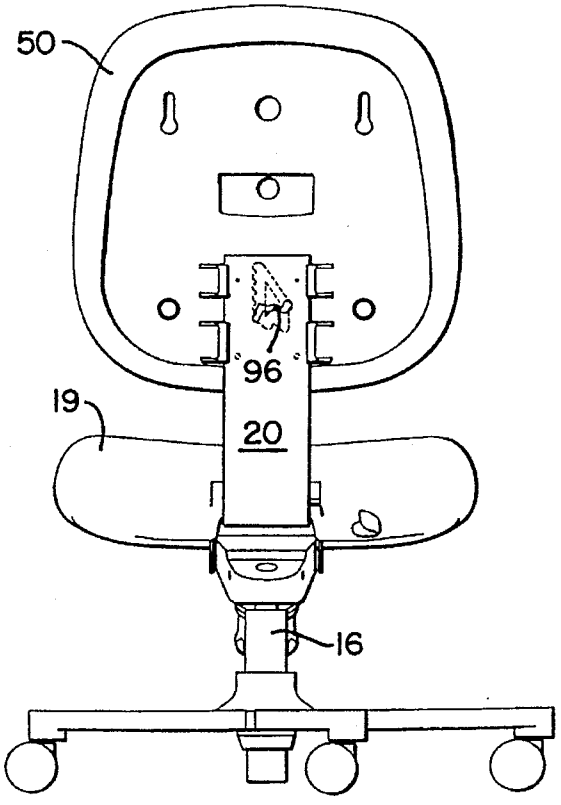
FIG. 11 is a back view of a chair with the backrest at the location at which the locking pin is in the hooked or stopped position.
Figure 10:
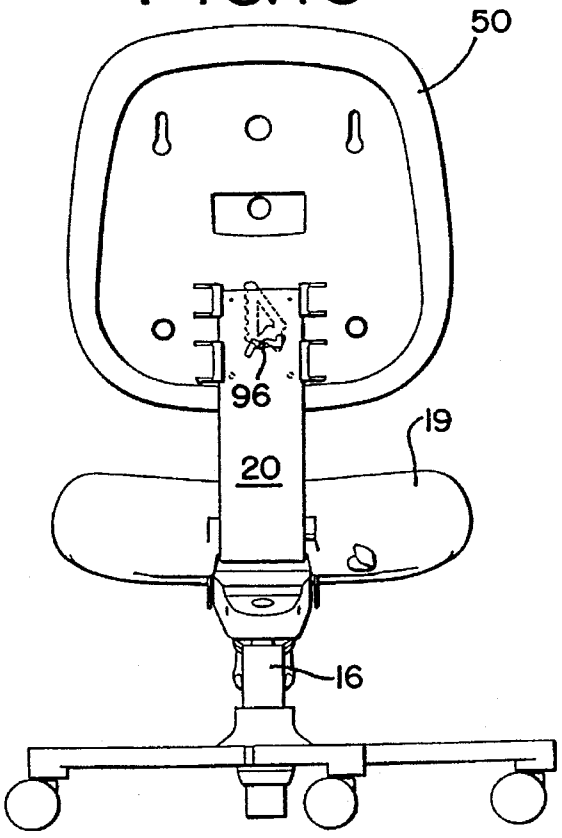
FIG. 10 is a back view of a chair with the backrest at the first rest position after the highest locked position.
Figure 9:
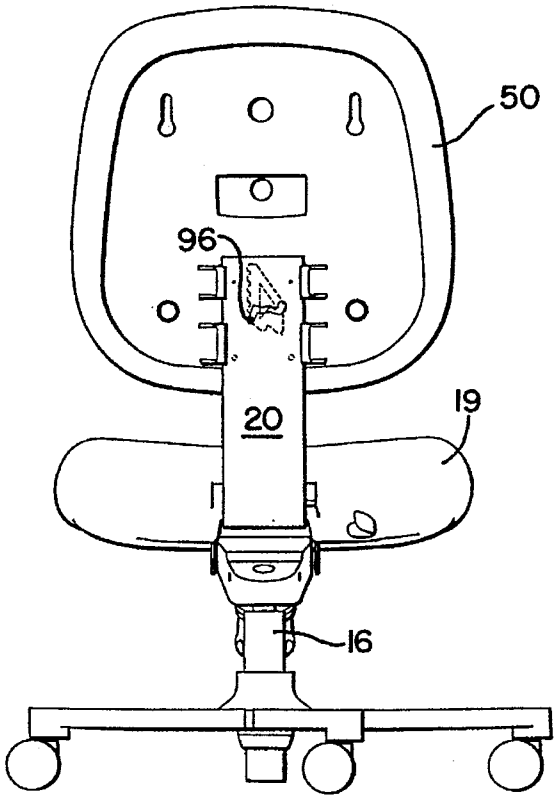
FIG. 9 is a back view of a chair with the backrest at its highest locked position.
Figure 13:
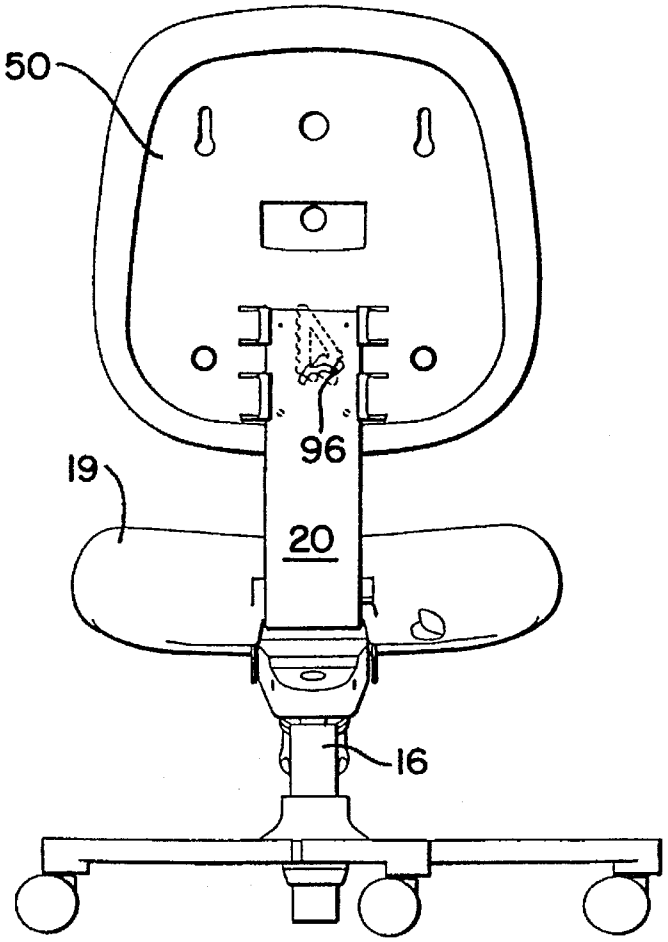
FIG. 13 is a back view of a chair with the backrest between the second rest position and the lowest locked position.
Figure 12:
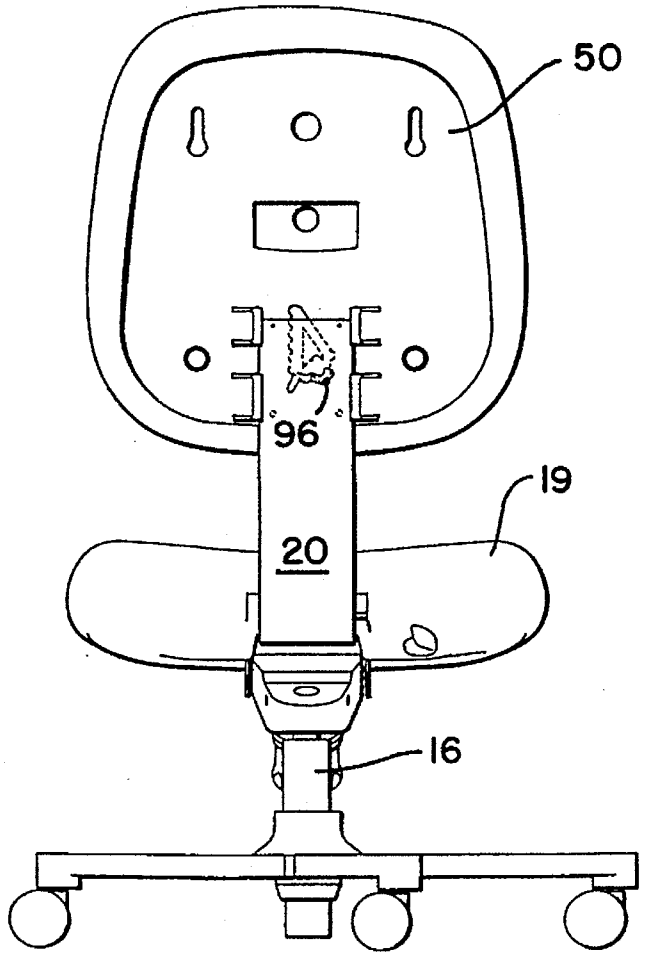
FIG. 12 is a back view of a chair with the backrest at the second rest position after the highest locked position.

The preferred embodiment of the invention is shown in FIG. 1 embodied in an office chair 10. The invention could of course be embodied in other type of chairs, furniture, shelves, panels or other furnishings.

The office chair illustrated in FIG. 1 has a base support 12 that is supported on the floor by rollers 14. A support column 16 extends vertically from the base support 12 and carries a seat support 18 at its upper end. A seat cushion 18 is shown on the upper surface of the seat support 18 and a backrest strap portion 20 extends upwardly from the seat support 18. The strap portion 20 is made from metal and thus provides a stable support for the backrest 50. A plastic insert plate 22 having a slot 24 formed therein is carried in an opening 26 formed in the strap portion 20. The head portion 96 of a locking device 90 can be seen at one end of the slot 24.

The backrest 50 includes a hard shell portion 52 which can be, as it is in the illustrated embodiment, cast from plastic. A cushion 54 is secured to the front surface of the shell portion 52 of the backrest 50. A plurality of projections 56 are cast integral with the shell portion 52 and include channels 58. The projections 56 and their channels 58 are dimensioned and located such that the vertically extending edges of the strap portion 20 is slidably received in the channels 58.

FIG. 2 is a view of the backrest 50 with the strap portion 20 separated therefrom so that the section of the hard shell 52 that is normally covered by the strap portion 20 is visible. In this section of the hard shell 52 there is a continuous groove 60 formed in the surface of the hard shell 52. The continuous groove 60 is located between the projections 56 and when the strap portion 20 is received in the channels 58 of the projections the slot 24 overlies the continuous groove 60. The strap portion 20 and the backrest 50 can be locked together, by a locking device 90, at a number of locked positions to thus enable the backrest to be located at a variety of positions relative to the chair seat. The locking device 90 includes a locking pin 92 that operates in cooperation with the slot 24 and continuous groove 60.

Referring now to FIG. 3 the locking pin 92 will be discussed. The locking pin 92 includes three concentric cylindrical sections or portions. The head portion 96, can be seen in FIG. 1, has a diameter that is greater than the width of slot 24 and its undersurface slides along the periphery of the slot 24. The slot follower portion 98 protrudes from the undersurface of the head portion 96. The slot follower portion 98 has a diameter, slightly smaller than the width of slot 24 such that the slot follower portion 98 can slide or roll freely within the slot 24. The track follower portion 94, located at the other end of the slot follower portion 98, has a diameter that corresponds to the continuous groove 60.

Referring now to FIGS. 4 and 5 the relationship between the slot 24 and the continuous groove 60 will be discussed. The slot 24 has a locking pin insertion opening 26 at one end. The diameter of the insertion opening 26 is large enough to permit the track follower portion 94 of the locking pin 92 to slide through but not large enough to permit passage of the head portion 96 of the locking pin 92. When inserting the locking pin 92 the backrest 50 is slid along the strap portion 20 to the location where the insertion opening 26 of the slot 24 is aligned with an insertion opening 62 which is a part of the continuous groove 60 (see FIG. 5). With the insertion openings 26 and 62 aligned, the track follower portion 94 of the locking pin 92 can be inserted through the aligned openings 26, 62. The locking pin 92 must be shifted to the left to dislodge it from the insertion openings 26, 62. This can be accomplished by sliding the backrest 50 down, which results in the track follower portion 94 moving to the left in the continuous groove 60 to a location where it is in engagement with the groove edge 66. It should be noted that, when sliding the backrest 50 relative to the strap 20, the channels 58 formed in the projections 56 limit this movement to the direction parallel to the vertical edges of the strap portion 20. In the process of dislodge the locking pin 92 from the insertion openings 26, 62 the slot follower portion 98 of the locking pin 92 has moved from the insertion opening 26 to the radius portion 28 of the slot 24. The incline 64 of the continuous groove 60 is at an angle A that is approximately 32 degrees from the vertical.

After the locking pin 92 has been dislodged from the insertion openings 26, 62 and the track follower portion 94 is in engagement with groove edge 66, the backrest 50 is then moved downwardly until the track follower portion 94 engages the upper edge of incline 64. The locking pin 92 is now in a location from which it can slide up the incline 64, however as the locking pin 92 moves up the incline 64 it must translate from right to left across the slot 24. In translating from right to left across the slot 24 the slot follower portion of the locking pin must climb an incline 30, descend a decline 32 and then climb a second incline 34 before reaching the radius position 36 of the slot 24 and the radius portion 68 of the continuous slot 60. As a result of climbing the inclines and descending the decline the person making the adjustment to the backrest experiences a change in the feeling as the backrest is moved downwardly. This change that the person experiences communicates to this person that the adjusting process is under control and reassure the person the system is operating properly.

As the backrest 50 continues in its downward movement, from the location at which the locking pin is at 36 in the slot 20 and 68 in the continuous slot 60, the locking pin shifts to the left to the radius 70 in the continuous slot 60 and begins descending the sloped portion 38 of the slot 20. When the locking pin 92 reaches the bottom 40 of the sloped portion 38 further downward movement of the backrest portion 50 is stopped. The backrest has arrived at its first locked position at which the locking pin 92 is at 70 in the continuous slot 60 and 40 in the slot 20. This is the lowest locked position of the backrest 50.

If it is desired to adjust the backrest to a higher locked position, the backrest 50 is manually raised by the person doing the adjusting, which causes the locking pin 92 to roll up the sloped portion 38 of the slot 24 to 36 and to the right in continuous slot 60 to 68. At this point further upward movement of the backrest is prevented by the engagement of the locking pin 92. The person doing the adjusting knows that when the upward movement of the backrest is stopped the backrest should be released or moved downwardly. As the backrest 50 moves downwardly the locking pin 92 is caused to move to the left by the sloped portion 38 of the slot 24. When the locking pin 92 reaches the bottom 40 of the sloped portion 38 it is at the second locked position 71. The is the second lowest locked position of the backrest 50.

If it is desired to raise the backrest from the locked position 71, the backrest is first raised until the track follower portion 94 of the locking pin 92 engages the upper edge of the incline 64, which stops further upward movement of the backrest 50. The person doing the adjusting then releases or moves the backrest down which causes the slot follower portion 98 of the locking pin 92 to be guided down the sloped portion 38 of the slot 24 until the third locked position 72 is reached. At this point the backrest cannot be moved further in the downward direction. This is the third lowest locked position.

The process for raising the backrest 50 to the fourth 73, fifth 74 and sixth 75 locked position is repeated. When raising the backrest 50 from the locked positions 72, 73, 74 and 75 the track follower portion 94 of the locking pin 92 is stopped when it engages the edge 65 of the center island 67.

The bracket 50 can be raised from locked position 75, which is the highest locked position. When the backrest 50 moves upwardly the track follower portion 94 of the locking pin 92 engages the first downwardly inclined cam surface 76 of the continuous slot 60 and follows it down to the first rest position 77 of the slot 60. Upward movement of the backrest 50 is stopped when the first rest position 77 is encountered. The person doing the adjusting then knows that the backrest 50 must now be released or moved downwardly. When this is done the track follower portion 94 of the locking pin 92 engages the first upwardly inclined cam surface 78 of the island 67. The locking pin 92 follows the cam surface 78 until the track follower portion 94 reaches a hooked edge of the island which is the stopped position 79. Engagement of the stopped position 79 stops the downward movement of the backrest 50 and the person doing the adjusting knows that the direction of movement of the backrest must be reversed. When the backrest 50 is moved upwardly the track follower portion 94 of the locking pin encounters the downwardly inclined cam surface 80 of the continuous slot 60 and slides down this edge until it reaches the second rest position 81. With the track follower portion 94 of the locking pin 92 is in the second rest position 81 the backrest can be lowered to its lowest locked position 70. In moving from the second rest position 81 of the continuous slot 60 the slot follower portion 98 of the locking pin 92 must again traverse from right to left across the slot 24. In making this traverse the locking pin 92 must climb the incline 30, descend the decline 32 and climb the incline 34.

While the invention has heretofore been described in detail with particular reference to the illustrated apparatus, it is to be understood that variations, modifications and the use of equivalent mechanisms can be effected without departing from the scope of this invention. It is, therefore, intended that such changes and modifications be covered by the following claims.

What is claimed is:

1. A device for adjusting and releasably locking a chair backrest in any of a plurality of vertical positions relative to the seat support comprising:

a. a seat support including a vertically extending strap portion, a slot formed in said vertically extending strap portion;

b. a chair backrest including a shell portion, slide slots formed in one of said strap portion and shell portion, slide edges received by said slide slots and formed on the other of said strap portion and shell portion such that said backrest slides vertically on said vertically extending strap portion of said seat support, a continuous track formed in hard material carried by said shell portion, said slot and said continuous track being in an overlapping relationship;

c. a locking device for releasably locking said backrest to said vertically extending strap portion of the seat support, said locking device comprising:

a lock pin, said lock pin including a track follower portion that is slidable in said track, a head portion that is adapted to engage said vertical strap portion along the periphery of said slot and a slot follower portion that connects the track follower portion to the head portion and is slidable in said slot, d. said slot and continuous track being formed such that the locking pin circumnavigates the continuous track and cycles from a lowest vertical locked position to a highest vertical locked position through all other vertical locked positions and is returned to its lowest vertical locked position by raising and releasing the backrest multiple times including: raising the backrest which brings the pin to a first rest position by a first downwardly inclined cam surface of the continuous track, then releasing the backrest which brings the pin to a stopped position between the highest and the lowest locked positions by an upwardly inclined cam surface, raising the backrest again which brings the pin to a second rest position by a second downwardly inclined cam surface, and releasing the backrest again which brings the pin into the lowest locked position.

2. The device as set forth in claim 1 wherein said continuous track is formed in hard material carried by said hard shell portion and is located between said slide slots.

3. The device as set forth in claim 1 wherein said continuous track is formed in the material of said shell and is in the form of a depressed groove having a raised island portion in a central portion of said groove.

4. The device as set forth in claim 1 wherein said vertically extending strap portion is formed from metal and has an opening formed therein, and said slot is formed in a plastic plate that is secured in said opening.

5. The invention as set forth in claim 1 wherein said slot and said continuous track each include a lock pin insertion portion that is sized to receive the track follower portion of the lock pin when said lock pin insertion portions are aligned.

6. The device as set forth in claim 1 wherein said continuous track includes a sinuous edge, each node of said sinuous edge defines a vertical locked position of the backrest.

7. The device as set forth in claim 1 wherein said slot includes an inclined portion that is closed at its lower end, such that the lock pin can slide down the inclined portion and will stop at its closed lower end.

8. The device set forth in claim 6 wherein said slot includes an inclined portion that is closed at its lower end, such that the lock pin can slide down the inclined and will stop at its closed lower end, nodes of the sinuous edge and the lower end of said inclined portion of said slot being aligned at each vertical locked position.

9. A device for adjusting and releasably locking a chair backrest in any of a plurality of vertical positions relative to the seat support of the type in which the backrest is vertically slidably mounted on the vertically extending strap portion of the seat support, the backrest and strap portion have overlapping tracks and slots including cam surfaces that receive a lock pin, the lock pin moves in the tracks and slots in response to gravity and the vertical movement of the backrest and the lock pin locks the backrest in a series of vertical locked positions, wherein the invention comprises:

said track including a first downwardly inclined cam surface that the lock pin encounters when the backrest is lifted from a highest locked position, said first downwardly inclined cam surface causes the lock pin to move laterally to a first rest position at which the backrest is at a higher elevation than its highest locked position;

said track includes a first upwardly inclined cam surface including a hook portion at its upper end, said upwardly inclined cam surface overlies said first rest position such that when said backrest is released the lock pin encounters said upwardly inclined cam surface and follows it into the hook portion, when said hook portion is encountered by said lock pin further downward movement of the backrest is prevented and the backrest is in a stopped position;

said track includes a second downwardly inclined cam surface that includes a second rest position at its lower end, said second downwardly inclined cam surface underlies said hook portion such that when said backrest is raised from its stopped position in the hook portion the lock pin encounters said second downwardly inclined cam surface and follows it down to said second rest position, said track includes a second upwardly inclined cam surface, the bottom portion of said second inclined cam surface overlies said second rest position and the upper portion of said second inclined cam surface terminating adjacent a lowest locked position of said track such that when the backrest is released from its second rest position the lock pin will encounter said second inclined cam surface and follow it to said lowest locked position.

10. The device as set forth in claim 9 wherein the device further includes:

said slot extending generally horizontal with inclining and declining portions;

when said lock pin is located in said first rest position of said track it is located in a depression in the slot between a declining and inclining portions which functions to insure that said lock pin will encounter said first upwardly inclined cam surface when the backrest is released.

11. The device as set forth in claim 7 wherein the device further includes:

said slot extending generally horizontal with inclining and declining portions;

when said lock pin is located in said second rest position of said track it is located in a depression in the slot at the bottom of declining and inclining portions which functions to insure that said lock pin will encounter said second upwardly inclined cam surface when the backrest is released.

12. The device as set forth in claim 10 wherein the device further includes:

when said lock pin is located in said second rest position of said track it is located in a depression in the slot at the bottom of a declining portion which functions to insure that said lock pin will encounter said second upwardly inclined cam surface when the backrest is released.

13. The device as set forth in claim 11 wherein the device further includes:

said second upwardly inclined cam surface has an angle of inclination that causes said lock pin to traverse the entire generally horizontal extent of said slot, causing it to change its direction as it climbs said inclines and descends said declines, as said lock pin slides from said second rest position to said lowest locked position, to prevent free fall of the backrest.

14. The device as set forth in claim 12 wherein the device further includes:

said second upwardly inclined cam surface has an angle of inclination that causes said lock pin to traverse the entire generally horizontal extent of said slot, causing it to change its direction as it climbs said inclines and descends said declines, as said lock pin slides from said second rest position to said lowest locked position, to prevent free fall of the backrest.

* * * * *

UNITED STATES PATENT AND TRADEMARK OFFICE

CERTIFICATE OF CORRECTION

PATENT NO. : 5,597,204

DATED : January 28, 1997

INVENTOR(S) : Donald G. Karaus, Jr.

It is certified that error appears in the above-identified patent and that said Letters Patent is hereby corrected as shown below:

Claim 5, line 1, delete "invention" and replace with --device--.

In Claim 11, line 1, delete "7" and replace with --9--.

Signed and Sealed this

Twelfth Day of May, 1998

Bruce Lehman

*Attest:*

BRUCE LEHMAN

*Attesting Officer*

*Commissioner of Patents and Trademarks*